US005519950A

United States Patent [19]

Wang

[11] Patent Number: 5,519,950

[45] Date of Patent: May 28, 1996

[54] STRUCTURE FOR ENGAGING A HEEL TO A SHOE

[76] Inventor: Chia-chin Wang, No. 9, Alley 12, Lane 882, Chung Cheng Rd., Feng Yuan City, Taichung Hsien, Taiwan

[21] Appl. No.: 423,121

[22] Filed: Apr. 17, 1995

[51] Int. Cl.[6] ..... A43B 21/36

[52] U.S. Cl. ..... 36/42; 36/36 R

[58] Field of Search ..... 36/42, 36 R, 36 A, 36/36 B, 36 C, 41

[56] References Cited

U.S. PATENT DOCUMENTS

| | | | |
|---|---|---|---|
| 1,645,187 | 10/1927 | Ducheneau | 36/36 R |
| 1,743,543 | 1/1930 | Guitierrez | 36/42 |
| 2,233,250 | 2/1941 | Easton | 36/42 |
| 2,252,404 | 8/1941 | Mauser | 36/36 R |
| 2,954,618 | 10/1960 | Rados | 36/36 R |

FOREIGN PATENT DOCUMENTS

| | | | |
|---|---|---|---|
| 1172169 | 2/1959 | France | 36/42 |

*Primary Examiner*—Paul T. Sewell
*Assistant Examiner*—Ted Kavanaugh
*Attorney, Agent, or Firm*—Hedman, Gibson & Costigan

[57] ABSTRACT

A structure for engaging a heel to a shoe, the heel having a tongue disposed to an underside thereof and the tongue having a first opening defined therein, the heel having a projection extending upwardly from a top thereof and a recess defined in the top, the projection having a groove defined in an inner portion thereof, a mediate element engaged to an underside of the tongue and having flanges extending laterally therefrom for being inserted into the groove, the mediate element having a second opening defined therein through which a hook element passes which is pivotally engaged between two inner sides defining the second opening and a hook portion of the hook element inserted into the recess of the heel.

2 Claims, 5 Drawing Sheets

STRUCTURE FOR ENGAGING A HEEL TO A SHOE

BACKGROUND OF THE INVENTION

The present invention relates to a structure for engaging a heel to a shoe and more particularly, to a structure replaceably engaging a heel to a shoe.

Conventionally, a shoe has a heel which is fixedly engaged to an outsole thereof by sewing, adhesion or nailing processes, however, if the heel is damaged, broken or disengaged from the outsole partially, as often occurs on a shoe with a high heel, the heel must be disengaged from the outsole firstly and then a new heel chosen to engage to the shoe through the processes mentioned above. To dispose the heel to the shoe needs a skilled shoe maker and usually takes a lot of time. Furthermore, for a customer, he or she would like to have a shoe which can be replaceably equipped with different heels easily such that he or she can have his or her shoes with different heels according to where he or she will go.

SUMMARY OF THE INVENTION

The present invention intends to provide a structure for engaging a heel to an outsole of a shoe so as to replace the heel with ease and to mitigate and/or obviate the above-mentioned problems.

The present invention provides a structure for engaging a heel to a shoe, the heel having a tongue disposed to an underside thereof and the tongue having a first opening defined therein, the heel having a projection extending upwardly from a top thereof and a recess defined in the top, the projection having a groove defined in an inner portion thereof, a mediate element engaged to an under side of the tongue and having a flange extending laterally therefrom for being inserted into the groove, the mediate element having a second opening defined therein through which a hook element passes which is pivotally engaged between two inner sides defining the second opening and a hook portion of the hook element inserted into the recess of the heel.

It is an object of the present invention to provide a structure for easily disposing a replaceable heel to a shoe.

Other objects, advantages, and novel features of the invention will become more apparent from the following detailed description when taken in conjunction with the accompanying drawings.

BRIEF DESCRIPTION OF THE INVENTION

DETAILED DESCRIPTION OF THE PREFERRED EMBODIMENTS

Figure 1:
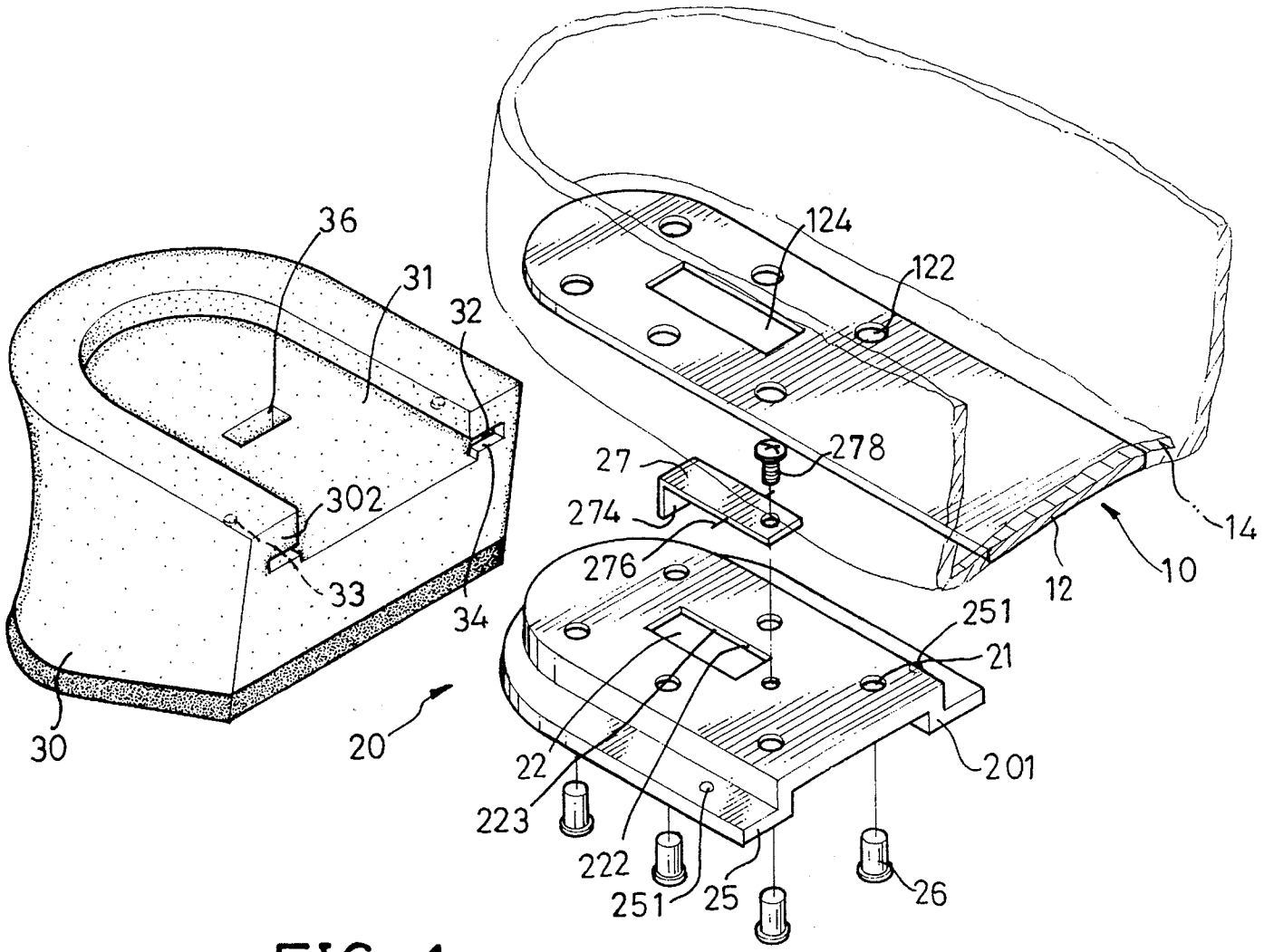
FIG. 1 is an exploded view of a heel, a hook element and a shoe in accordance with the present invention.
Figure 2:
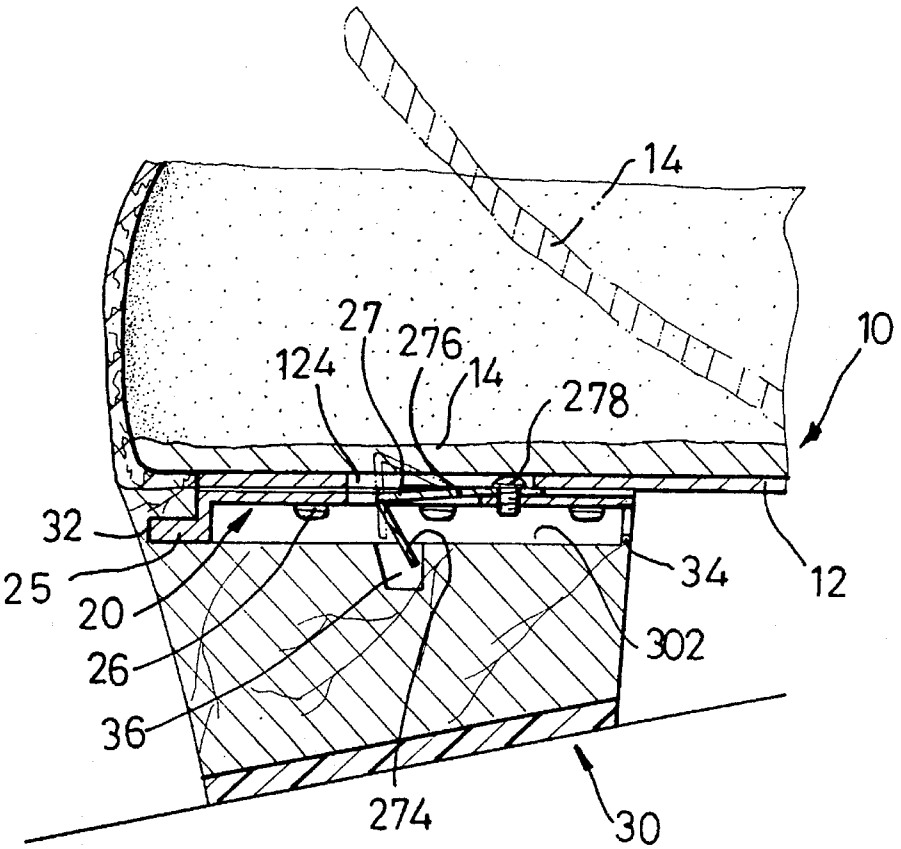
FIG. 2 is a side elevational view, partly in section, of the heel disposed to the shoe in accordance with the present invention.

Referring to the drawings and initially to FIGS. 1 and 2, a structure for engaging a heel to a shoe in accordance with the present invention generally includes the shoe 10, a mediate element 20, the heel 30 and a hook element 27, the shoe 10 having a front end and a rear end, the rear end thereof having a tongue 12 longitudinally disposed to an underside thereof, the tongue 12 having a plurality of first holes 122 and a first opening 124 defined therein. The mediate element 20 has a U-shaped configuration and has a periphery, the periphery having a wall 201 extending downwardly therefrom and a flange 25 horizontally extending from a bottom of the wall 201 and away from the mediate element 20, a boss 251 extending upwardly from an upper surface of the flange 25. The mediate element 20 has a plurality of second holes 21, corresponding to the first holes 122, and a second opening 22, corresponding to the first opening 124, respectively defined therein, the second opening 22 defined by two pairs of opposite inner sides 223. The mediate element 20 is engaged to the tongue 12 by extending rivets 26 through the second holes 21 and the first holes 122.

The heel 30 has a top 31 and a bottom, the top 31 thereof having a projection 302 extending upwardly therefrom to form an open end, the projection 302 having a groove 32 defined in an inner portion thereof for receiving the flange 25 of the mediate element 20 and the top 31 thereof having a recess 36 defined therein. A stop 34 extends upwardly from the open end of the top 31 and is located within the groove 32, a depression 33 is defined in a under surface of the projection 302 for receiving the boss 251 therein when the flange 25 is inserted into the groove 32.

The hook element 27 made of flexible material has a first end and a second end, the first end thereof having a hook portion 274 and the second end thereof fixedly engaged to the mediate element 20 by a bolt 278, the hook portion 274 being inserted into the recess 36 of the heel 30 via the second opening 22. The hook element 27 has a pin 276 which extends laterally from each side thereof and is pivotally engaged within the second opening 22 of the mediate element 20 by inserting each of the pins 276 into a hole 222 defined in the inner side 223 defining the second opening 22.

Figure 3:
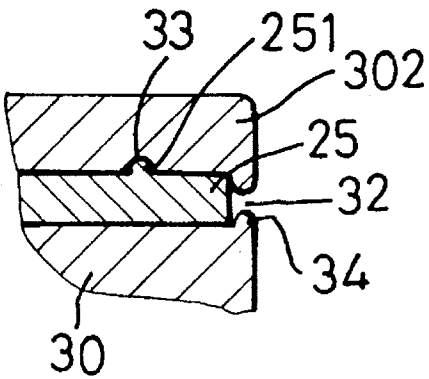
FIG. 3 is a side elevational view in section of the flange received in the groove of the heel and is retained by the stop of the heel.

When assembling the heel 30 and the shoe 10, further referring to FIG. 3, the heel 30 is pushed toward the mediate element 20 to let the flange 25 pass over the stop 34 and be received in the groove 32 until the boss 251 is received in the depression 33, the hook portion 274 is inserted in the recess 36 and an insole 14 is disposed on the tongue 12, wherein the stop 34 prevents the flange 25 from disengaging from the groove 32 such that the heel 30 is securely engaged to the shoe 10. When disengaging the heel 30 from the shoe 10, the insole 14 is pulled upwardly and the first end of the hook element 27 is pulled upwardly via the first opening 124 and the second opening 22 to disengage from the recess 36 so as to permit the heel 30 to be slid from the mediate element 20 of the shoe 10.

Figure 4:
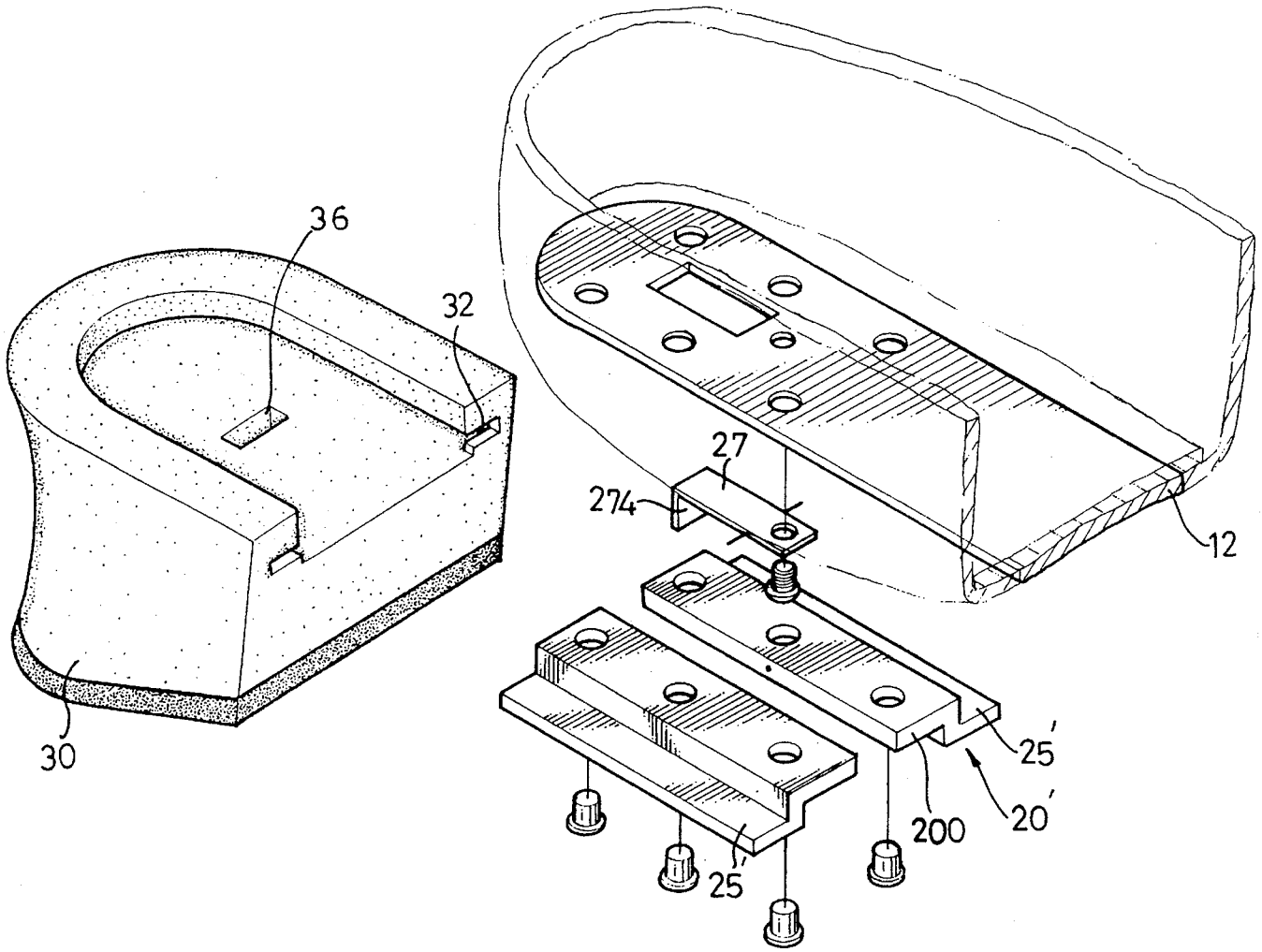
FIG. 4 is an exploded view of another embodiment of the mediate element, the hook element, the heel and the shoe.

FIG. 4 shows another embodiment of the present invention wherein the mediate element 20 is composed of two halves 200 each of which has a flange 25 for being received in the groove 32 of the heel 30, the second end of the hook element 27 is fixedly engaged to the tongue 12 and the hook portion 274 of the hook element 27 is still inserted into the recess 36.

Figure 5:
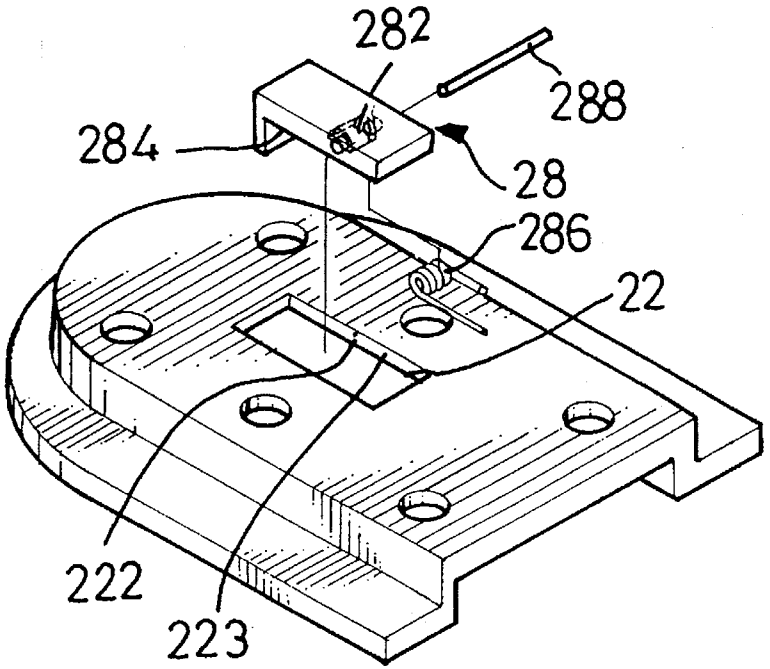
FIG. 5 is an exploded view of yet another embodiment of the mediate element and the hook element.
Figure 6:
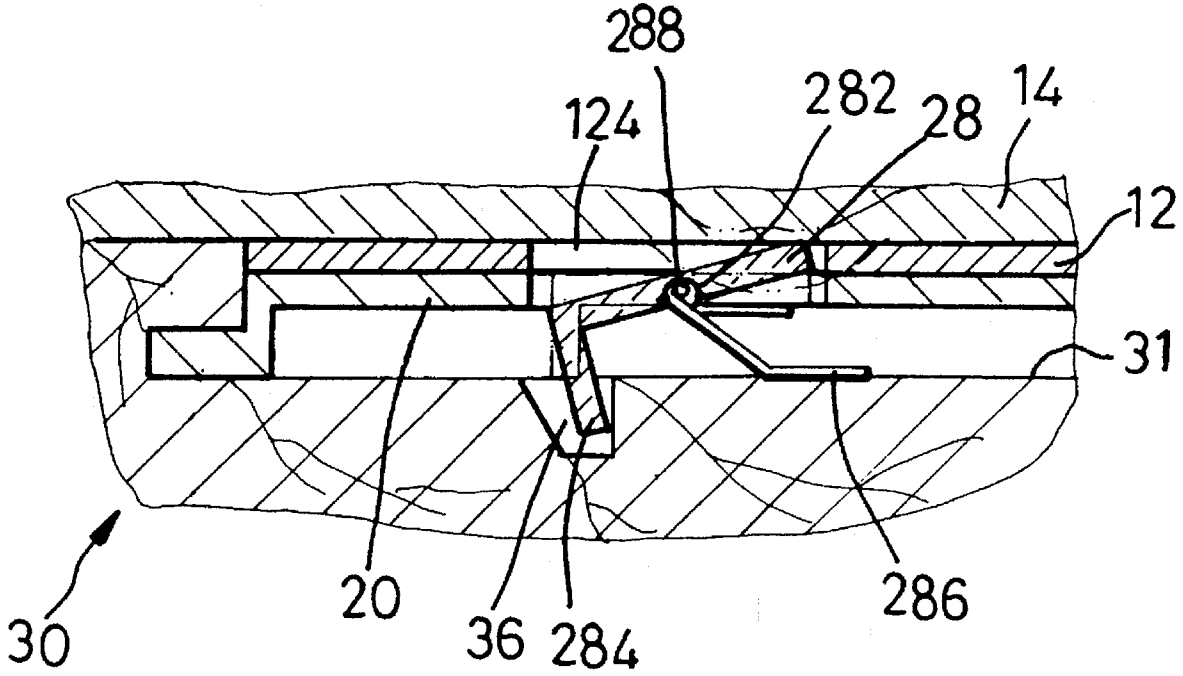
FIG. 6 is a side elevational view, partly in section, of the embodiment shown in FIG. 5.

FIGS. 5 and 6 show yet another embodiment of the hook element 28 which has a bore 282 defined in an under side thereof in which a biasing element 286 is received and a pin 288 passes through the biasing element 286 and pivotally engages in the holes 222 defined in the inner sides 223 defining the second opening 22, the biasing element 286 having two ends respectively engaged against the top 31 of the heel 30 and the underside of the hook element 28 so as to bias a hook portion 284 inserted into the recess 36. The hook portion 284 is disengaged from the recess 36 simply by pushing the second end of the hook element 28 toward to the heel 30 so as to disengage the heel 30 from the mediate element 20.

Although the invention has been explained in relation to its preferred embodiment, it is to be understood that many other possible modifications and variations can be made without departing from the spirit and scope of the invention as hereinafter claimed.

I claim:

1. A structure for engaging a heel to a shoe, said shoe having a front end and a rear end, said heel having a top and a bottom, said top thereof having a projection extending upwardly therefrom and having an open end defined by said projection, said projection having a groove defined in an inner portion thereof and said top of said heel having a recess defined therein, said structure comprising:

a tongue having a plurality of first holes and a first opening defined therein for attaching to the underside of the shoe, a mediate element having a periphery, said periphery having a wall extending therefrom and a flange horizontally extending from a bottom of said wall and away from said mediate element for inserting in said groove of said heel, said mediate element having a plurality of second holes, corresponding to said first holes, and a second opening, corresponding to said first opening, respectively defined therein, said second opening defined by at least two opposite inner sides and said mediate element engaged to said tongue by extending rivets through said first holes and said second holes, and a hook element having a first end and a second end, said first end thereof having a hook portion and said second end thereof fixedly engaged between said tongue and said mediate element, said hook element having two sides and a pin extending laterally from each of said two sides and pivotally engaged within said second opening of said mediate element by inserting each said pin into a hole defined in said inner side defining said second opening and, said hook portion for inserting into said recess defined in said top of said heel.

2. The structure as claimed in claim 1 wherein said flange has a boss extending upwardly from an upper surface thereof and said projection has a depression defined in an under surface thereof for receiving said boss in said depression.

* * * * *